US005428582A

United States Patent [19]

Madden et al.

[11] Patent Number: 5,428,582

[45] Date of Patent: Jun. 27, 1995

[54] DECOUPLING RING

[75] Inventors: Peter E. Madden, Shaker Heights; Paul N. Turner, Concord Township, Lake County; Daniel N. Kosareo, Lyndhurst, all of Ohio

[73] Assignee: Westinghouse Electric Corporation, Pittsburgh, Pa.

[21] Appl. No.: 255,864

[22] Filed: Jun. 7, 1994

[51] Int. Cl.[6] ..... H04R 17/00

[52] U.S. Cl. ..... 367/162; 367/165; 367/173; 367/176; 367/153; 114/21.3; 310/326

[58] Field of Search ..... 114/21.3; 367/162, 165, 367/173, 176, 153, 155; 310/337, 326

[56] References Cited

U.S. PATENT DOCUMENTS 3,854,060 12/1974 Cook ..... 367/155
4,192,246 3/1980 Hodges et al. ..... 114/23
4,463,454 7/1984 Hemond et al. ..... 367/173
4,731,763 3/1988 Wagner ..... 367/153
4,989,530 2/1991 Thompson, Jr. et al. ..... 114/21.3
5,007,030 4/1991 Sullivan et al. ..... 367/153

*Primary Examiner*—J. Woodrow Eldred

[57] ABSTRACT

A decoupling ring provided on the front annular face of the nose shell of a craft, surrounding the sonar array. This ring decouples the vibration in the nose shell from the fluid path. The decoupling ring is constructed of one or more mass elements on one or more compliance elements. The individual compliance elements are preferably vibrationally speaking springs and the mass elements are preferably metal segments which form a mass-spring system. The dimensions and characteristics of the mass and compliance rings are chosen to have a fundamental resonant frequency well below the sonar frequency range of interest, thus acting as a low pass filter. When the vibrational energy has a frequency above the resonant frequency of the mass spring system, the vibrational energy is attenuated effectively. The low frequency resonance of the decoupling ring is obtained by using a large mass and a large compliance in the mass and compliance elements, respectively.

6 Claims, 3 Drawing Sheets

FIG. 5
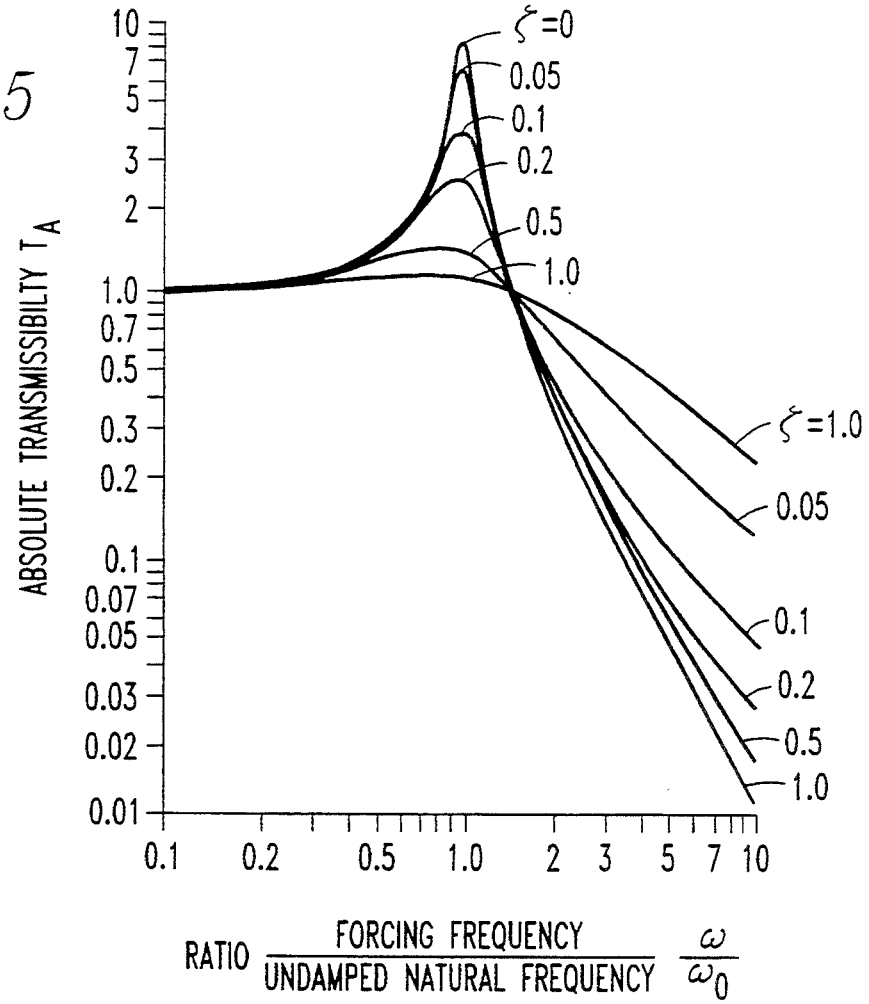
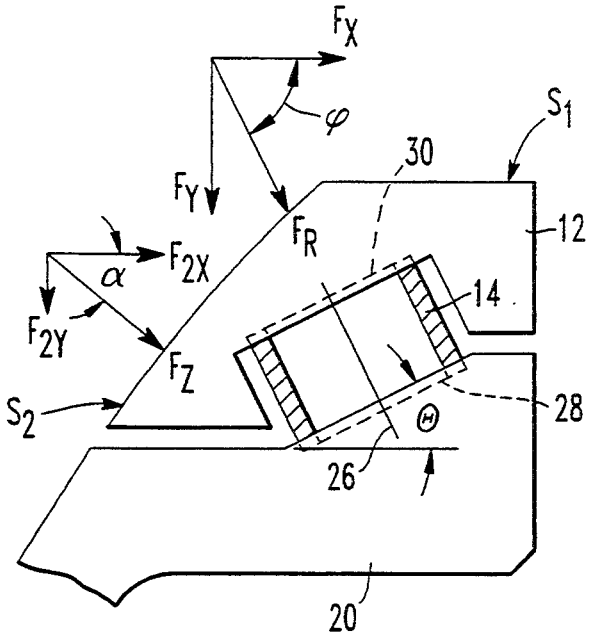
FIG. 6

DECOUPLING RING

BACKGROUND OF THE INVENTION

1. Field of the Invention

This invention relates generally with reducing self noise in sonar systems. More particularly, the invention relates to reducing self noise from water flow vibrations and machinery noise in underwater acoustic systems.

2. Description of the Prior Art

A sonar array works by detecting the incoming pressure fluctuations due to the sound a target makes in the water. The pressure responses of each individual sonar array element are converted into electrical signals which are added together coherently (i.e., the phase of the signals with respect to each other must be taken into account) to give the array output.

The term "self noise" as used with sonar arrays describes the noise in the output signal of the array due to vibrations in the sonar array structure or the platform upon which the array is mounted. The sonar array is comprised of multiple sonar elements. Each sonar element is connected to an array mounting plate by an isolation mount. The isolation mount is a spring-like device, typically fabricated from a cylindrical section of a somewhat compliant material.

Low self noise is desirable because it enables the sonar to detect low level incoming signals. This in turn increases the acquisition range for a specified target. Assuming all electrical sources of self noise have been eliminated or minimized, mechanical sources are the next sources to consider.

For underwater vehicles, an acoustic array is typically mounted on the front or nose of the craft. As the craft moves through the water, the water flow travels around the nose and at some point along the shell of the craft, the water flow turns from laminar to turbulent. The vibrations due to this transition are a source of noise whereby energy from the turbulence is transferred through the nose structure to the array, exciting the array elements through two paths. The first path is through the tip of the nose into the fluid and enters the elements via the pressure response. The second math is through the array mounting plate and the element's isolation mount.

Experiments indicate the dominant path that the vibrational energy follows (i.e., through the water or through the array mounting) depends on the type of sonar beam that is formed. For beams formed from a single element or from a few elements, the water path is usually dominant. For beams formed from many elements, the path through the array plate and element isolation mount is dominant. However, when vibrations through the element's mounting have been reduced, as with the two stage trilaminar isolation mount, reducing vibration transmission through the fluid path provides significant additional reductions for both single element and multi-element beams.

Several methods have been proposed in the industry for reducing self noise. One technique is to design the contour of the nose shell to delay the onset of turbulent flow to a point substantially downstream from the nose. This moves the source of vibration further back along the shell away from the array.

Another technique is to design the shell with large impedance mismatches which reduce the transmission down the shell. Sonar array windows that wrap around the nose shell can provide some damping of vibrations in the shell as can damping material applied directly to the inside of the shell. Shells made of composite construction have also been tested. Array element mounting techniques that reduce the vibration transmitted through the element mounts are the standard way of reducing sonar self noise.

Self NOise REduction (SNORE) rods have been tested in the industry to reduce the diffraction of sound around the torpedo nose shell. However, SNORE rods have been largely ineffective because diffraction of sound is not presently a major cause of self noise. Reducing self noise caused by direct vibration transmission through the fluid path has not been addressed.

In arrays presently known in the art, a solid ring which is part of the shell surrounds the array. In this arrangement, the vibrations are transferred down the shell and can get into the array by radiating from the ring and coupling through the water path into the sonar elements. Alternatively, the vibrations can get into the elements via the vibration response of each element because the elements sit on a plate which is caused to vibrate by the turbulence.

The industry has attempted to address the self noise problem in underwater sonar devices. However, with the exception of the SNORE rod concept, which dealt with the diffraction of sound around the nose shell and not at the more critical problem of radiation from the nose shell, no attempt has been made to reduce vibration transmission in the fluid coupling path. Thus, self noise reduction techniques are needed which address the problem of self noise caused by a vibration transmission through the fluid path.

SUMMARY OF THE INVENTION

A decoupling ring is provided that is placed upon and is integral with the front annular face of the nose shell of an underwater craft surrounding that craft's sonar array. The decoupling ring decouples the vibration in the nose shell from the fluid path. In its most general configuration, it is comprised of a mass ring on a compliant ring. The dimensions and characteristics of the mass and compliance are chosen not only to satisfy structural requirements due to operational loads, but also to have a fundamental resonant frequency well below the sonar operating frequency range. In this way, the decoupling ring acts as a low pass filter.

The decoupling ring may consist of a single ring-like mass element on a single ring-like compliant element, multiple mass elements on a single compliant element, a single mass element on multiple compliance elements or multiple mass elements on multiple compliance elements. Preferably, multiple masses are provided on respective multiple compliance elements. Thus, a mass spring system is created.

The decoupling ring is designed to resonate at a low frequency. When the vibrational energy has a frequency well above the resonant frequency of the decoupling ring, the vibrational energy is attenuated effectively. The resonant frequency of the decoupling ring is designed to be at a frequency well below that of the vibrational energy in order to provide effective attenuation. The low frequency resonance is obtained by using a large mass with the mass element(s) and a large compliance or low stiffness in the compliance element(s) (compliance being the inverse of stiffness). The individual compliance elements are vibrationally speaking springs and the mass elements are annular metal segments.

Other objects and advantages of the invention will become apparent from a description of certain present preferred embodiments thereof shown in the drawings.

BRIEF DESCRIPTION OF THE DRAWINGS

FIG. 5 is a plot of the motion transmissibility vs. $\omega/\omega_0$.

FIG. 6 is a schematic depiction of a mass element on the compliance element showing the angle at which the compliance element is mounted to the nose shell.

DETAILED DESCRIPTION OF THE PREFERRED EMBODIMENT

Figure 1:
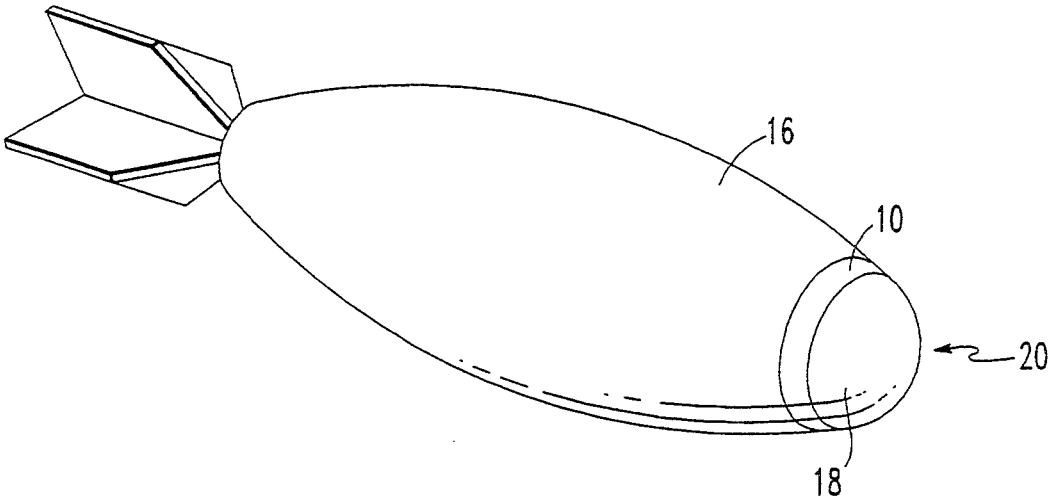
FIG. 1 is a perspective view of an underwater craft employing the preferred decoupling ring.

Referring first to FIG. 1, a decoupling ring 10 is provided that replaces the front annular face of the nose shell 20 that surrounds the sonar array 18 of an underwater craft 16. The sonar array 18 operates within a bandwidth of frequencies hereinafter referred to as the frequency range of interest. The decoupling ring 10 decouples the vibration in the nose shell 20 from the fluid path thus reducing noise at the array 18.

Figure 2:
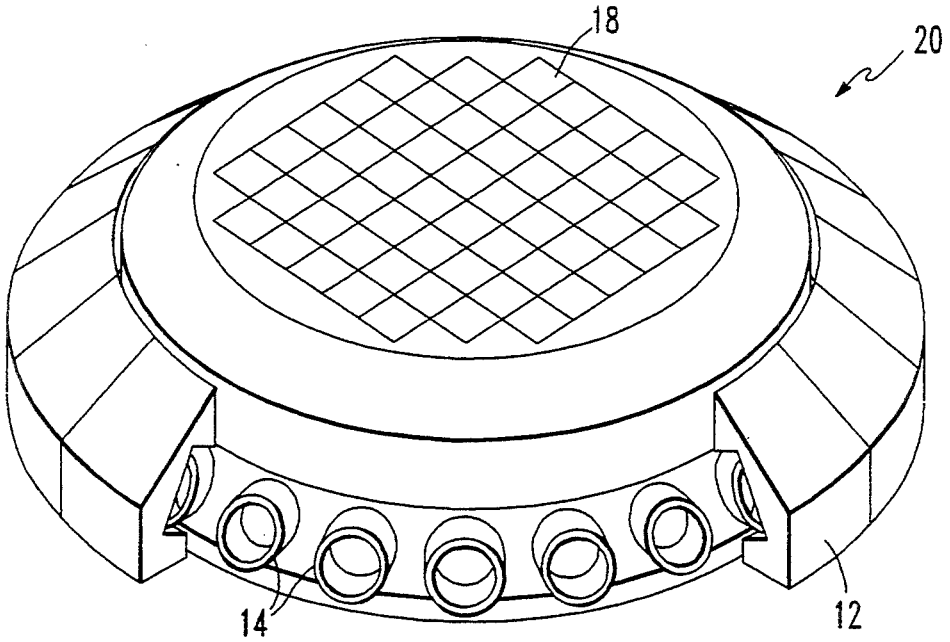
FIG. 2 is a perspective view of a portion of the underwater craft and first preferred decoupling ring, showing several masses mounted on respective compliance members.

Referring next to the first preferred embodiment of the decoupling ring, shown in FIG. 2, it is preferred that a number of individual mass elements 12 be mounted, respectively, on a number of individual compliance elements 14. Any number of mass elements 12 and compliance elements 14 may be utilized. Note that both the mass elements 12 and compliance elements 14 are arranged in an annular fashion. The individual compliance elements 14 are preferably tubular syntactic foam springs. The mass elements 12 are preferably metal segments, wherein the metal may be steel or steel with tungsten inserts to increase the mass.

The dimensions and characteristics of the mass elements 12 and the compliance elements 14 are chosen not only to satisfy structural requirements due to operational loads, but also to have a fundamental resonant frequency well below the sonar frequency range of interest. In this way, the decoupling ring 10 acts as a low pass filter.

The mass elements 12 and compliance elements 14 must be connected to one another and to the vehicle 16 in such a way that the mass element 12 is isolated from the shell, and there are no flanking paths whereby the unwanted vibrations can bypass the decoupling ring. These flanking paths occur, for example, if the decoupling ring mass element 12 is in contact with the shell, or if an unisolated screw or bolt connects the mass element 12 to the shell.

In one preferred embodiment, a counterbore 28 (shown best in FIG. 6) is machined in the nose shell 20 to provide a seat for the compliance element and to align the mounting axis 26 of the compliance element 14 with the resultant pressure load vector. Similarly, a counterbore 30 (shown best in FIG. 6) in the mass element 12 aligns the mass element 12 along the mounting axis 26. In the preferred embodiment a suitable epoxy is used to bond the compliance element 14 to the shell 20 and the mass element 14 to the compliance element 12.

The mass and compliance elements 12, 14 are rotated through an angle $\theta$ from the radial axis of the shell 20 so that their mounting axis is aligned with the resultant pressure load vector as will be explained in more detail below.

Figure 3:
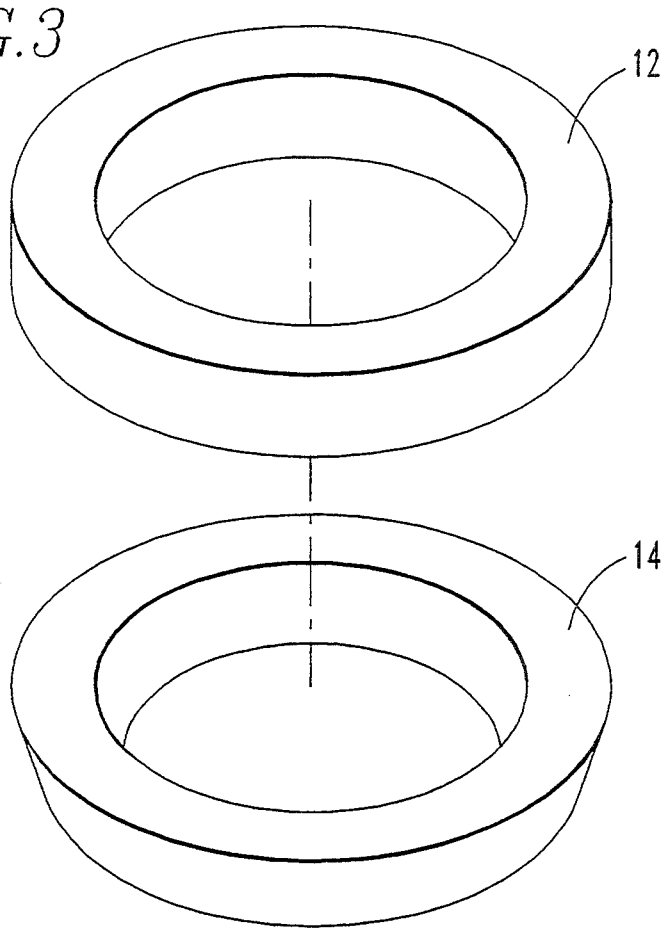
FIG. 3 is an exploded perspective view of a second preferred decoupling ring.

In the second preferred decoupling ring configuration, shown in FIG. 3, the decoupling ring 10 is comprised of a single mass element 12 connected to a single compliance element 14. As in the first embodiment, the annular mass element 12 is connected directly to the annular compliance element 14 in such a way as to isolate the mass element 12 from the shell 20 so that there are no flanking paths for the unwanted vibrations. This second preferred embodiment, except for having only one compliance element 14 and one mass element 12, is otherwise similar to the first preferred embodiment and may be attached in a similar manner. As with the first preferred decoupling ring, the second preferred decoupling ring has a mass element 12 and a compliance element 14 that is attached to the vehicle 16 in such a way that its mounting axis is aligned with the resultant pressure load vector. This is discussed more fully below.

it is distinctly understood that the mass element 12 and compliance element 14 of decoupling ring 10 may be comprised of a single annular mass element 12 (ring) on a single annular compliance element 14 (ring), a number of individual mass elements 12 on a single annular compliance ring 14, a single mass element 12 on individual compliance elements 14, or a number of individual mass elements 12 on respective individual compliance elements 14. In the event that multiple mass elements 12 and/or multiple compliance elements 14 are utilized, it is preferred that the individual mass elements 12 and compliance elements 14 are arranged, respectively, in a ring-like fashion around the sonar array 18.

Figure 4:
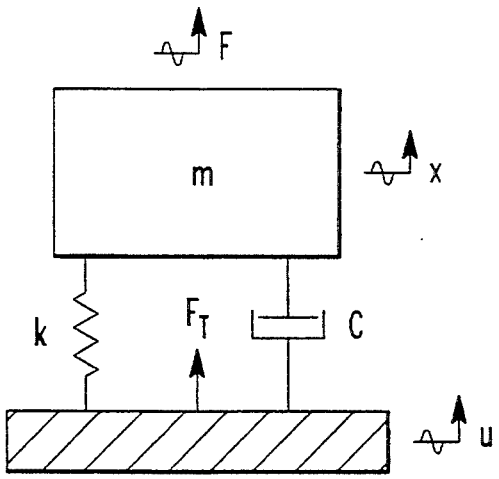
FIG. 4 is a spring-mass-damper representation of the decoupling ring.

The operation and design considerations of the decoupling ring are better understood by describing the decoupling ring 10 as a spring-mass-damper system. A single degree-of-freedom spring-mass-damper representation of the decoupling ring 10 is shown in FIG. 4. The foundation represents the nose shell 20 which is excited by the oscillation motion due to the shell vibrations induced by the turbulent boundary layer. The spring and damper collectively represent the decoupling ring compliance element 14, and the mass (m) represents the decoupling ring mass element 12. The compliance element 14 and mass element 12 together comprise the decoupling ring 10. The mass element 12 is excited by the vibrational motion of the nose shell 20. The vibrational motion is transmitted into the sonar array 18 through the fluid path and the pressure response of the array elements.

The motion transmissibility ($T_A$) is defined as the ratio of the vibration amplitude of the decoupling ring mass element (represented as $x_0$) to the vibration amplitude of the nose shell (represented by $u_0$). For the system depicted in FIG. 4, this transmissibility (represented as $T_A$), is given by:

$$T_A = \frac{x_0}{u_0} = \sqrt{\frac{1 + \left(2\xi \frac{\omega}{\omega_0}\right)^2}{\left(1 - \frac{\omega^2}{\omega_0^2}\right)^2 + \left(2\xi \frac{\omega}{\omega_0}\right)^2}}$$

where $\omega$=the frequency of the foundation excitation;

$\omega_0$=the resonant frequency of the undamped spring-mass system; and $\xi$=the percent of critical damping of the spring-mass system.

The fraction of critical damping, $\xi$, is given by $$\xi = \frac{C}{C_c}$$

where

C=the viscous damping coefficient; and $C_c$=the critical viscous damping coefficient.

The critical viscous damping coefficient, $C_c$, is the smallest value of C for which the mass m will execute no oscillations if it is displaced from equilibrium and released. This is given by $$C_c = \sqrt{km} = 2m\omega_0$$

Thus, the fraction of critical damping, $\xi$, is a measure of how near the viscous damping coefficient, C, is to the critical viscous damping coefficient, $C_c$.

$\xi$ cannot be calculated from a knowledge of the system, but can be determined from one of several different measurements of the vibration characteristics of the system. Typically, the exact value of $\xi$ is not necessary (it is sufficient to know that $\xi$ is very small). Except for structures that are purposely treated with additional damping treatments, damping is usually ignored.

The resonant frequency of the undamped spring-mass system is given by:

$$\omega_0 = \sqrt{\frac{k}{m}}$$

where k is the stiffness of the compliance element and m is the mass of the decoupling ring mass element. The mass, m, of the mass element is determined from the density of the material from which the mass element is fabricated.

A plot of the transmissibility, $T_A$, vs. $\omega/\omega_0$ is shown in FIG. 5. This plot shows that for light damping, $\xi << 1$, (typical of most structures), there is a pronounced increase in the vibration amplitude when the forcing frequency of the excitation equals the resonant frequency of the system, i.e., $\omega/\omega_0=1$. However, when the forcing frequency of the excitation reaches about four times the resonant frequency, $\omega/\omega_0=4$, the transmissibility has been reduced about 23 dB ($20*\log_{10}(0.07/1.0)$), and at ten times the resonant frequency, $\omega/\omega_0=10$, the reduction is about 40 dB ($20*\log_{10}(0.01/1.0)$).

For the case of the decoupling ring employed with a sonar, a reduction of the transmission of vibrations in the sonar frequency range is the goal. Thus, for example, to achieve a 40 dB reduction in vibration transmissibility, the decoupling ring is designed so as to have a resonant frequency of about 1/10 that of the mean frequency of the sonar's frequency range of interest.

The compliance element 14 is preferably constructed of a syntactic foam, such as the type manufactured by Metro Tool Company. The preferred compressure modulus of the syntactic foam is approximately 425,000 psi. The preferred compressive strength of the syntactic foam is approximately 12,500 psi. The compliance elements are preferably made out of syntactic foam, but they could be made out of any suitable material.

The stiffness of the compliance element is given by:

$$k = \frac{EA}{L}$$

where

E=the compressive modulus of the syntactic foam compliance element;

A=the cross-sectional area of the syntactic foam compliance element; and

L=the length of the syntactic foam compliance element.

The decoupling ring 10 is designed to resonate at a low frequency relative to the frequency range of interest. For vibrations having frequencies well above the resonant frequency of the decoupling ring 10, the vibrational energy is attenuated. The low frequency decoupling ring resonance is obtained by using a large value of mass for the mass element 12 and a large value of compliance in the compliance element 14 (or low stiffness, as compliance is the inverse of stiffness).

The resonant frequency of the decoupling ring 10 is lower by some amount than the desired frequency at which attenuation is desired to take place. Preferably, the resonant frequency of the decoupling ring 10 is approximately one tenth of the center frequency of the sonar band of the array 18.

The vibration in the shell of the craft 16 is annenuated so that the vibrations acting on the decoupling ring 10 around the sonar array 18 are reduced. The vibrational energy within the frequency range of interest of the sonar array contacts the decoupling ring 10 and the amplitude of the vibrational energy is reduced through contact with the decoupling ring 10. Therefore, by reducing the amplitude of the vibrations at the decoupling ring 10, the energy that enters into the sonar array elements through the decoupling ring via the water path is reduced.

To integrate the decoupling ring 10 into the nose shell 20, the front annular section of the nose shell 20 must be machined back. FIG. 6 is one preferred representation of the decoupling ring 10 showing the mass element 12 on the compliance element 14 attached to the shell structure of the craft 16. The following description of the angled mounting of the decoupling ring applies to a single mass element and compliance element or multiple mass elements and compliance elements. As can be seen in FIGS. 2 and 6, the angle of the cut and location of the counter bore for the compliance element 14 is based upon the resultant load vector on the decoupling ring due to depth pressure. As can be seen in FIG. 6, the compliance element 14 is situated on the nose shell 20 so as to be positioned in a direction that is an an angle $\theta$ to the radial axis of the craft 16. The angle at which the compliance element is mounted is selected to be aligned with the direction of the load on the craft due to water pressure. This angled mounting of the compliance element 14 enables the decoupling ring to be operational at large depths. The mass element 12 is designed so as to have a center of mass that lies upon the geometric center of the compliance element 14. This prevents harmful motions from being excited.

To determine the angle of attachment of the decoupling ring 10 to the nose shell, the direction of the equivalent load on the decoupling ring due to the water pressure must be obtained. The mounting axis 26 of the compliance element 14 is aligned with the load vector to reduce unbalanced forces on the decoupling ring 10.

Referring further to FIG. 6, $F_R$ is the resultant load vector on the mass due to the pressure of the water, and is composed of force components in the x-direction, $F_x$, and in the y-direction, $F_y$. These forces are determined from the force $F_1$ on the upper surface of the mass, and $F_2$ on the side surface of the mass.

The forces $F_1$ and $F_2$ are calculated by multiplying the pressure acting on the surface by the surface area, $S_1$ for the upper surface and $S_2$ for the side surface. In turn, these forces have components in the x- and y-directions. $F_1$ is resolved into a force only in the y-direction so that $F_1=F_{1y}$. The force $F_2$ is resolved into forces $F_{2x}$ and $F_{2y}$.

The total force in the x- and y-directions is $$F_x=F_{2x}$$

$$F_y=F_{1y}+F_{2y}$$

The angle of the resultant force, $F_R$ is $$\Phi = \tan^{-1}\frac{F_y}{F_x}$$

The angle $\theta$ from the radial axis of the vehicle at which the syntactic foam ring should be attached so that its axis is aligned with the load vector $F_R$ is:

$$\theta=90^\circ-\phi$$

Variations of the preferred embodiments could be made. For example, on array configurations that have window supports, the window supports are also replaced by a mass compliance support to decouple vibrations in the window supports from the fluid path.

While certain present preferred embodiments have been shown and described, it is distinctly understood that the invention is not limited thereto but may be otherwise embodied within the scope of the following claims.

We claim:

1. A decoupling ring for use with a craft having an array of sonar elements mounted in the nose shell of the craft, wherein the sonar array has a selected range of operating frequencies, the decoupling ring comprising:

at least one compliance element arranged in an annular fashion around the sonar array, the at least one compliance element having a selected compliance and being affixed at one end to the craft; and at least one mass element arranged in an annular fashion around the sonar array, the at least one mass element being affixed to the at least one compliance element;

wherein the decoupling ring is sized and configured so as to have a resonant frequency below the operating frequency range of the sonar array.

2. The decoupling ring of claim 1 wherein each at least one compliance element is configured as a cylinder of compliant material.

3. The decoupling ring of claim 1 wherein the compliant material is syntactic foam.

4. The decoupling ring of claim 1 wherein each at least one mass element is fabricated of at least one of steel and tungsten.

5. The decoupling ring of claim 1 wherein the resonant frequency of the decoupling ring is roughly one-tenth of a center frequency of the operating frequency bandwidth of the sonar array.

6. The decoupling ring of claim 1 wherein the at least one mass element and the at least one compliance element are mounted to the craft at a selected angle relative to a radial axis of the craft, so as to be aligned in the direction of a load vector acting on the craft due to water pressure.

* * * * *